US005996448A

United States Patent [19]

Suekage

[11] Patent Number: 5,996,448

[45] **Date of Patent: *Dec. 7, 1999**

[54] SOCKET WRENCH

[75] Inventor: Takahiro Suekage, Miki, Japan

[73] Assignee: Daido Corporation, Somerset, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/822,361

[22] Filed: Mar. 20, 1997

[30] Foreign Application Priority Data

Dec. 20, 1996 [JP] Japan ..... 8-013545

[51] Int. Cl.[6] ..... B25G 1/04

[52] U.S. Cl. ..... 81/177.2; 81/177.5

[58] Field of Search ..... 81/177.2, 177.5, 81/177.85, 177.7, 180.1

[56] References Cited

U.S. PATENT DOCUMENTS

| | | | |
|---|---|---|---|
| 1,473,436 | 11/1923 | Leopold . | |
| 1,578,065 | 3/1926 | Bemus et al. | 81/177.5 |
| 2,691,316 | 10/1954 | Brame | 81/177.2 |
| 2,864,418 | 12/1958 | Vaughn . | |
| 2,951,405 | 9/1960 | Engquist . | |
| 3,343,434 | 9/1967 | Schroeder | 81/177.2 |
| 3,376,768 | 4/1968 | Fortunato | 81/177.2 |
| 3,779,107 | 12/1973 | Avery . | |
| 4,334,445 | 6/1982 | Timewell . | |
| 4,596,167 | 6/1986 | White . | |
| 4,711,145 | 12/1987 | Inoue . | |
| 5,218,891 | 6/1993 | Olson . | |
| 5,280,740 | 1/1994 | Ernest . | |
| 5,295,422 | 3/1994 | Chow . | |

FOREIGN PATENT DOCUMENTS

| | | | |
|---|---|---|---|
| 885760 | 9/1943 | France | 81/177.85 |

*Primary Examiner*—David A. Scherbel
*Assistant Examiner*—Lee Wilson
*Attorney, Agent, or Firm*—Londa and Traub LLP

[57] ABSTRACT

A socket wrench has a rigid extension provided for attachment to the handle portion. The extension has at a first end thereof a receiving portion for matingly receiving a spline-drive shank of the wrench handle through a rear face of the extension, and has a spline-drive shank extending perpendicularly from a forward face of the extension at a second, opposite end thereof. A low clearance is maintained such that the forward face of the second end of the extension resides in a plane substantially parallel to or rearward of the forward face of the head. The socket wrench may further include a ratchet head attachment having its lower end recessed at its rear face for receiving the second end of the extension therein.

5 Claims, 3 Drawing Sheets

SOCKET WRENCH

BACKGROUND OF THE INVENTION

The present invention relates to a wrench, particularly a socket wrench of the ratchet type, having an extension mechanism removably attachable to the head portion, allowing for a multitude of variable positions, and especially permitting use within a confined space.

Prior art wrenches exist which have included an extension device. However, these wrenches suffer from drawbacks which make them difficult or impossible to use in situations in which there is little or no room to maneuver.

U.S. Pat. No. 2,691,316 to Brame teaches a ratchet wrench having an extension means removably attachable to the head portion of the wrench. The head portion includes a square shaped shank projection, which mates with a square receiving portion on the extension means. This mating structure allows for a solid, but nonvariable, connection between the wrench handle and the extension. Furthermore, the effective operating depth of the wrench with the extension is too great for very narrow work spaces.

U.S. Pat. No. 4,334,445 to Timewell provides an extension means for a socket wrench comprising a rod hinged at one end thereof to a socket for engaging a square shank of the wrench head, and hinged at its other end to a shank which further engages a socket. The rod is thus adjustable into a Z shape, but suffers from the above drawbacks in that the hinged socket and shank portions add to the effective operating depth of the wrench, and the square shanks provided permit operation within only a single plane.

Therefore, it is an object of the invention to provide a socket wrench having a rigid extension means and ratchet head mechanism which are configured to maintain a shallow operating depth of the wrench.

It is a further object of the invention to provide a socket wrench having a rigid extension means and a ratchet head which permit a multitude of adjustable configurations at different angles.

SUMMARY OF THE INVENTION

Accordingly, the present invention relates to a socket wrench comprising a handle portion comprising a shaft, and a head at one end of the shaft, a first shank extending perpendicularly in a forward direction from a forward face of the head. A rigid extension means is provided for attachment to the handle portion. The extension means comprises at a first end thereof a receiving portion for matingly receiving the first shank through a rear face of the extension means, and a second shank extending perpendicularly from a forward face of the extension means at a second, opposite end thereof. To achieve a multitude of positions, the first shank and the second shank may each be shaped in cross-section as a spline-drive.

In an assembled state, a low clearance is maintained such that the forward face of the second end of the extension means resides in a plane substantially parallel to or rearward of the forward face of the head. In addition, the rear face of the second end resides in a plane substantially parallel to or forward of a rearmost point of the handle portion; and the forward face of the second end of the extension means resides in a plane rearward of the rear face of the first end.

In order to maintain sufficient strength to withstand the torque applied to by the wrench, the extension means should be of rigid construction, preferably formed of a single metal piece. The second shaft may be a separate piece, firmly secured to the extension means.

The invention may further comprise a ratchet head having an upper end with a third shank projecting perpendicularly from a forward face of the upper end, a rear face of the upper end, and on a lower end of the ratchet head a means for receiving the second shank of the extension means through a rear face of the lower end.

In the assembled state, the forward face of the ratchet head lies in a plane substantially parallel with or rearward of the forward face of the first end of the extension means. To further insure a low clearance, the rear face of the lower end of the ratchet head is recessed with respect to the rear face of the upper end, wherein the depth of the recess is substantially equal to or less than the thickness of the second end of the extension means.

DETAILED DESCRIPTION OF THE INVENTION

Figure 1:
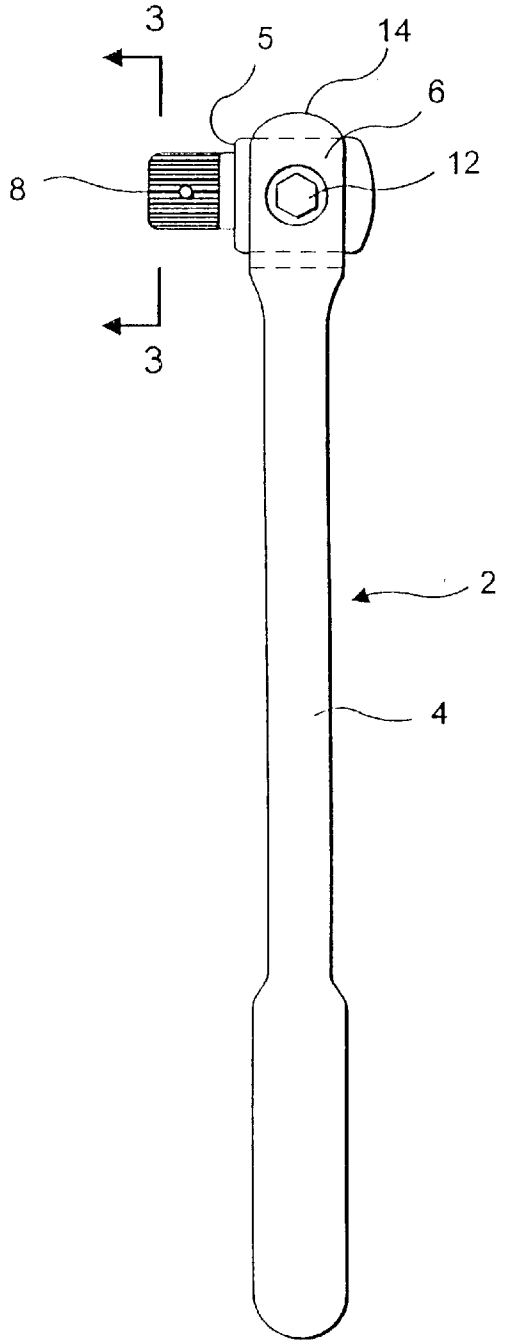
FIG. 1 is a side elevation view of a handle portion of the invention showing an embodiment with a forked head.
Figure 2:
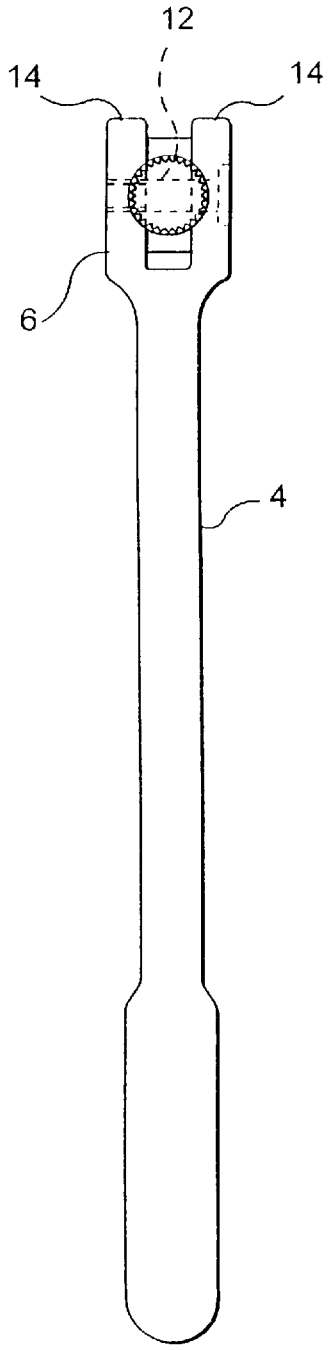
FIG. 2 is front elevation view of FIG. 1.
Figure 3:
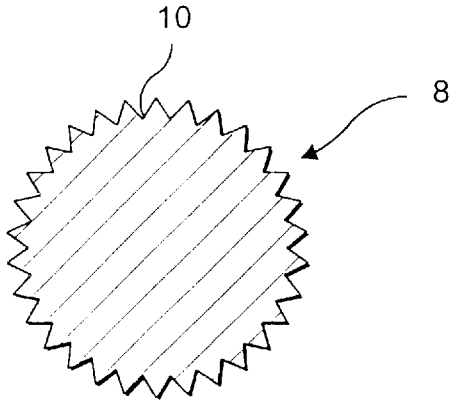
FIG. 3 is a cross-sectional view of a spline-drive shaft, viewed from III—III of FIG. 2.

As shown in FIGS. 1 and 2, a handle portion 2 comprises a shaft 4 and a head 6. A shank 8 projects perpendicularly from a forward face 5 of the head 6. The shank may be square in cross-section, but is preferably of the spline-drive type, consisting of a plurality of adjacent axial ribs 10 situated about the circumference of the shank, each rib being shaped as an inverted "V" pointing in the radially outward direction. The spline-drive may also be described as having the cross-section of a gear, as shown in FIG. 3. The shank 8 may be fixed with respect to the handle 2, or may be adjustable about a pivot axis 12. In a preferred embodiment, the head 6 is shaped to have two spaced-apart fork ends 14. The shank resides between the fork ends and is fixed pivotally thereto about an axle 16.

Under normal operating conditions, the wrench may be fitted with any of a plurality of standard sockets, each of which has a receiving portion which conformingly mates with the shank, usually of square cross-section, of an intermediate adapter which itself has a spline-drive receiving end. Furthermore, a ratchet head may be fitted on the first shank as well. In particular, the spline-drive allows for numerous arrangements of the socket about the shank, as opposed to a square shank, and thus may permit easier fitting of the socket around a nut in a location which does not permit a great degree of angular movement. An embodiment having the forked head also adds to the adjustability and versatility of the wrench.

In order to provide an even greater degree of variability, a removable extension means 20 (see FIGS. 4–7) is provided between the handle portion 2 and the operating element, be it an intermediate adapter or ratchet head. The extension means 20 comprises a rigid element, which in itself is non-adjustable, so as to convey sufficient strength and torque from the handle to the socket. At a first end 21 of the extension means, a receiving means 22 is provided on a rear face 23 for matingly receiving the shank 8 of the handle portion. At the second, opposite end of 25 the extension means, a second shank 24 is provided, projecting preferably perpendicularly from the forward face 27 of the extension means 20. It is preferable that the second shank 24 is also of the spline-drive type. As a result, the extension means 20 may be mated at various positions with respect to the first shank 8 of the handle, and again at various position with respect to an operating element. Thus, a multitude of positions can be achieved between the handle and the operating element, by way of the extension means, in that the operating element may be at a plurality of different rotational positions and may also be at a plurality of different "orbiting" positions with respect to the first shank 8. In addition, the operating element with an appropriate socket may be easily fitted onto a nut located in a place with little room for angular movement, which furthermore may be located in a difficult to reach place.

Figure 4:
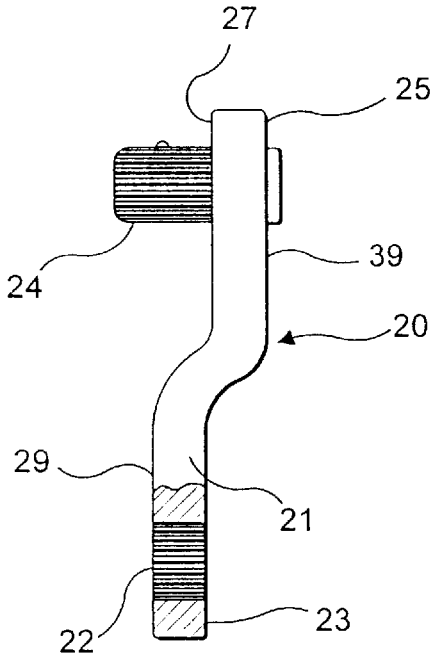
FIG. 4 is a side elevation view of an extension means of the invention.

A further advantage of the invention may be seen in a preferred embodiment, as in FIG. 4, which the extension means 20 is offset such that the forward face 29 of the first end 21 is in a different plane from the forward face 27 of the second opposite end 25. In particular, the forward face 27 of the second end 25 is situated in a plane located rearward of the rear face 23 of the first end 21. This orientation may be achieved by forming the extension means 20 with a slight S-shaped bend, in which the forward faces 27, 31 of the first end and second end are parallel, but offset. It will be understood that it is important to maintain the strength of the extension means, so that a rigid, one-piece construction is preferable, e.g. by way of a single flat forged or rolled metal piece, bent or stamped into an offset shape. With an extension means formed in this manner, the second shank 24 may extend with respect to the face 5 of the head 6 with similar clearance as the first shank 8. A wrench of this construction will thus allow for extended reach, without adding to the additional operating depth of the wrench, to thus permit operation in a space having low clearance. In this regard, it is also preferable that the extension means 20 be formed such that the rearward facing portion of the second, swept back end, does not project significantly beyond the rear plane 7 of the handle/head portion.

Figure 5:
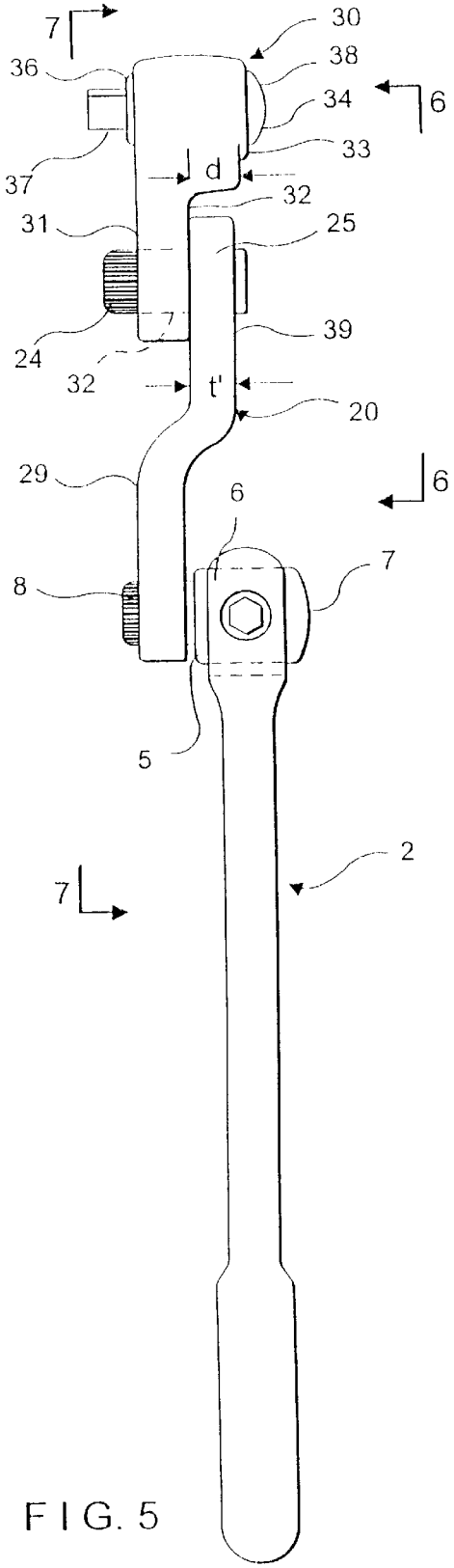
FIG. 5 is a side elevation view of an embodiment of the invention showing, in an assembled state, a handle portion, extension means, and ratchet head mechanism.
Figure 6:
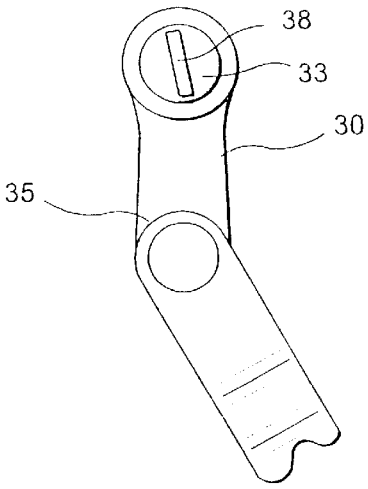
FIG. 6 is a partial rear view of the embodiment of FIG. 5, showing the ratchet head and portion of the extension means in an angled orientation.
Figure 7:
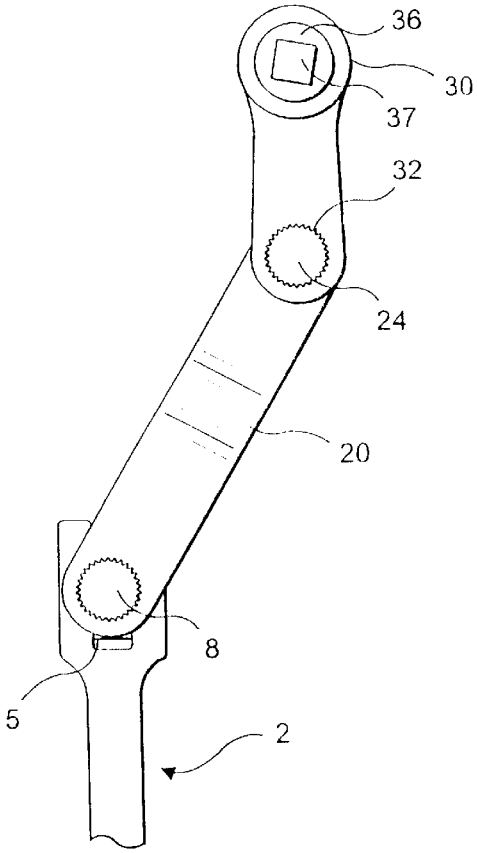
FIG. 7 is a partial front view of the embodiment of FIG. 5, showing the ratchet head in angled orientation with the extension means, and the extension means in angled orientation with the handle portion.

To further insure the lowest possible clearance of the wrench, a specially formed ratchet head mechanism (or intermediate non-ratcheting socket adapter) may be provided in which a lower end 31, for connecting to the second end 25 of the extension means 20, is recessed. In particular, as shown in FIG. 5, the lower end 31 of the ratchet head 30 contains a receiving means 32 for matingly receiving the second shank 24 of the second end of the extension means through the rear face 32 of the ratchet head lower end 31. Preferably, the rear face 32 of the lower end is recessed with respect to the rear face 33 of the upper end 34, which generally requires a larger depth to contain the ratcheting mechanism. Thus, the lower end of the ratchet lead is in the form of a cut-out notch in the ratchet head attachment. To allow for a variety of rotational positions within the recess, the upper edge 35 of the second end of the extension means may have a rounded profile when viewed from the face on direction (see FIG. 6). The upper end 34 of the ratchet head 30 has, on its forward face 36, a shank 37 for mating with a socket, and has on its rear face a pawl mechanism 38 for selecting the direction of the ratchet.

In order to maintain low clearance, the ratchet head 30 should be formed so that, when attached to the extension means 20, the forward face 36 of the ratchet head does not extend substantially forward of the forward face 29 of the first end of the extension means. In addition, the rear face 33 of the ratchet mechanism should not extend substantially rearward of the rear most point of the extension means 39 or the handle portion 7. To advantageously achieve this, the depth "d" of the cut-out notch should be substantially equal to or less than the thickness "t" of the second end 25 of the extension means.

What is claimed is:

1. A socket wrench comprising:

a handle portion comprising a shaft, and a head at one end of the shaft, said head having a forward face lying in a plane, a first shank extending perpendicularly in a forward direction from the forward face of the head, a rigid extension means comprising a first end and a second end opposite therefrom, each of said first and second ends having a forward face and a rear face, the rear face of the first end having a receiving portion for matingly receiving the first shank therethrough, and a second shank fixed to the forward face of the second end, the second shank being shaped for mating engagement with a receiving means of a ratchet head, the second shank extending perpendicularly in the forward direction, and a ratchet head, the ratchet head having an upper end with a forward face and a rear face, and a lower end of the ratchet head having a rear face, a third shank projecting rotatably and perpendicularly from the forward face of the upper end, and a means for receiving the second shank of the extension means through the rear face of the lower end, the rear face of the lower end of the ratchet head being recessed with respect to the rear face of the upper end, the depth of the recess being substantially equal to or less than the thickness of the second end of the extension means, wherein, in an assembled state, the forward face of the second end of the extension means resides in a plane which is substantially co-planar with the plane of the forward face of the head, a rearmost point of the handle portion lies in a plane, and the rear face of the second end of the extension means resides in a plane which is substantially parallel to but forward of the plane of the rearmost point of the handle portion, and the forward face of the ratchet head lies in a plane which is substantially co-planar with the plane of the forward face of the first end of the extension means.

2. The wrench of claim 1, wherein the first shank and the second shank are each shaped in cross-section as a spline-drive.

3. The wrench of claim 1, wherein the head comprises two spaced-apart fork ends, and the first shank resides pivotably therebetween.

4. The wrench of claim 1, wherein an upper edge of the second end of the extension means is rounded in profile when viewed in a face-on direction.

5. The wrench of claim 1, wherein the extension means is of a rigid construction.

* * * * *